US012276102B2

(12) United States Patent
Bell

(10) Patent No.: US 12,276,102 B2
(45) Date of Patent: Apr. 15, 2025

(54) INTERLOCKING CONSTRUCTION BLOCK SYSTEM

(71) Applicant: Philip Louis Bell, Valparaiso, IN (US)

(72) Inventor: Philip Louis Bell, Valparaiso, IN (US)

( * ) Notice: Subject to any disclaimer, the term of this patent is extended or adjusted under 35 U.S.C. 154(b) by 286 days.

(21) Appl. No.: 17/866,064

(22) Filed: Jul. 15, 2022

(65) Prior Publication Data

US 2024/0018776 A1 Jan. 18, 2024

(51) Int. Cl.
*E04B 2/46* (2006.01)
*E04B 2/02* (2006.01)

(52) U.S. Cl.
CPC ..... *E04B 2/46* (2013.01); *E04B 2002/0206* (2013.01); *E04B 2002/023* (2013.01)

(58) Field of Classification Search
CPC ..... E04B 2/46; E04B 2002/0206; E04B 2002/023
USPC ..... 52/606
See application file for complete search history.

(56) References Cited

U.S. PATENT DOCUMENTS 541,815 A * 6/1895 Lee, Sr. ..... E04C 1/395 52/375
543,582 A * 7/1895 Meyenberg ..... E04C 1/00 52/600
595,169 A * 12/1897 Hanson ..... E04B 2/02 52/591.2
708,499 A * 9/1902 Searight et al. ..... E04B 2/02 52/603
964,160 A * 7/1910 Hammett ..... E04B 2/02 52/444
1,025,406 A * 5/1912 Koenig ..... E04C 1/00 52/444
1,071,467 A * 8/1913 Savage ..... E04B 5/40 52/327
1,271,447 A * 7/1918 Doern ..... E04B 1/4185 52/562
1,377,062 A * 5/1921 De Forrest ..... E04B 2/14 52/444
1,495,439 A * 5/1924 Reagan ..... E04B 2/14 52/100

(Continued)

FOREIGN PATENT DOCUMENTS

CA 2192270 C * 1/2000 ..... E02D 29/02

*Primary Examiner* — James M Ference
(74) *Attorney, Agent, or Firm* — Hartman Global IP Law; Gary M. Hartman; Domenica N. S. Hartman

(57) ABSTRACT

Interlocking construction blocks of a type that can be used as part of a system for building various structures, such as walls. An individual block provides positive intermeshing with other blocks abutting thereto and positive interlocking with other blocks stacked thereon, forming a joint that allows the abutting blocks to be held together without the need for mortar. Interlocked blocks are capable of providing a barrier against horizontal water seepage along the joints from one side of the interlocked blocks to the opposite side. The blocks provide a relatively light-weight structural unit while still providing good structural strength against horizontal and vertical loads. The blocks may be formed at least partly of recycled waste material(s) and/or may themselves be made of materials that can be easily recycled, thereby providing an environmentally friendly construction material that may have a reduced carbon footprint compared to other construction block systems.

30 Claims, 6 Drawing Sheets

(56) References Cited

U.S. PATENT DOCUMENTS 1,534,060 A * 4/1925 Dexter ..... E04B 2/28 52/562
1,654,631 A * 1/1928 Bevier ..... E04B 2/02 52/302.4
1,683,441 A * 9/1928 Glenn ..... E04B 2/42 52/606
1,953,154 A * 4/1934 Cram ..... E02B 3/14 52/439
1,988,492 A * 1/1935 Henderson ..... E04B 2/14 52/439
2,206,205 A * 7/1940 Selby ..... E04B 2/12 52/592.1
2,514,536 A * 7/1950 Burney ..... E04C 1/395 52/27
2,911,818 A * 11/1959 Smith ..... E04B 2/18 52/606
3,036,407 A * 5/1962 Dixon ..... E04B 2/10 52/439
3,148,477 A * 9/1964 Bjphirn ..... A63H 33/082 D21/500
3,229,439 A * 1/1966 Strobel ..... E04B 2/12 D25/113
3,478,482 A * 11/1969 Weir ..... E04G 21/14 52/745.11
3,650,079 A * 3/1972 Lubin ..... E04B 2/52 52/444
3,780,484 A * 12/1973 Muse ..... E04B 2/46 52/568
3,936,987 A * 2/1976 Calvin ..... E04B 2/08 52/309.1
4,016,692 A * 4/1977 Jordan ..... E01C 5/005 D25/113
4,035,975 A * 7/1977 Gergely ..... E04B 2/18 52/592.1
4,041,660 A * 8/1977 Yensen ..... E04B 2/22 D25/113
4,041,670 A * 8/1977 Kaplan ..... E04B 2/18 52/592.2
4,090,338 A * 5/1978 Bourgade ..... E04F 15/022 52/392
4,115,980 A * 9/1978 Martel ..... E04B 2/46 446/87
4,258,522 A * 3/1981 Amaral ..... E04C 1/40 52/309.1
4,341,050 A * 7/1982 Long ..... E04B 2/24 52/848
4,439,967 A * 4/1984 Dielenberg ..... E04B 2/26 52/439
4,485,604 A * 12/1984 Palamara ..... E04C 1/39 52/436
4,597,236 A * 7/1986 Braxton ..... E04B 2/18 52/564
4,619,560 A * 10/1986 Crinnion ..... E02B 3/066 52/597
4,671,039 A * 6/1987 Hunt ..... E04B 2/18 52/562
4,719,737 A * 1/1988 Swart ..... E04B 2/12 D25/113
4,860,505 A * 8/1989 Bender ..... E02D 29/025 52/592.6
4,887,403 A * 12/1989 Bonner ..... E04B 2/18 52/286
4,922,678 A * 5/1990 Scheiwiller ..... E02D 29/025 52/570
5,035,098 A * 7/1991 Newsom ..... E04C 1/40 52/576
5,402,609 A * 4/1995 Kelley, Jr. ..... E04B 2/32 52/561
5,657,597 A * 8/1997 Loftus ..... E04B 7/02 52/294
5,775,046 A * 7/1998 Fanger ..... A47B 87/007 108/158.12
6,176,059 B1 * 1/2001 Cantarano ..... E04B 1/6179 52/592.1
6,226,951 B1 * 5/2001 Azar ..... E04B 2/54 52/592.1
6,591,547 B1 * 7/2003 Staten ..... A01G 9/28 47/33
7,007,436 B1 * 3/2006 Kelley ..... E04B 2/16 52/309.7
7,048,250 B2 * 5/2006 Mothes ..... B28B 17/0018 425/436 R
7,845,266 B2 * 12/2010 Duke ..... F42D 5/045 89/36.01
8,201,370 B1 * 6/2012 Goodwin ..... E04B 2/46 52/592.6
8,291,669 B2 * 10/2012 Karau ..... E04C 1/395 D25/113
8,490,359 B2 * 7/2013 Perotti ..... A01G 9/28 47/33
8,667,752 B2 * 3/2014 Pollack ..... E01C 5/06 52/302.1
9,404,255 B1 * 8/2016 Castro ..... E04B 2/54
9,809,971 B2 * 11/2017 Roberts ..... E04B 1/32
10,501,929 B2 * 12/2019 Henry ..... E04B 1/2604
2001/0022057 A1 * 9/2001 Miller ..... E04C 1/397 52/309.12
2002/0112399 A1 * 8/2002 Riccobene ..... A01G 9/28 47/33
2003/0014937 A1 * 1/2003 Azar ..... E04B 2/06 52/604
2003/0079432 A1 * 5/2003 Azar ..... E04B 2/16 52/561
2005/0005556 A1 * 1/2005 Collier ..... E04B 2/18 52/582.1
2006/0101762 A1 * 5/2006 Shillingburg ..... E04C 1/395 52/503
2008/0047220 A1 * 2/2008 Hagenah ..... E01C 5/06 52/606
2008/0134616 A1 * 6/2008 Craven ..... E04B 2/18 52/606
2008/0295440 A1 * 12/2008 Esterhuizen ..... E04B 2/18 52/606
2013/0031848 A1 * 2/2013 Perotti ..... A01G 9/28 52/747.1
2013/0247503 A1 * 9/2013 Yong ..... E01C 5/00 52/604
2013/0312359 A1 * 11/2013 Weber ..... E04B 2/30 52/606
2016/0346707 A1 * 12/2016 Kuo ..... E04B 2/12
2018/0223524 A1 * 8/2018 Mohamed ..... E04C 1/397
2020/0048898 A1 * 2/2020 Rey Farias ..... E04B 2/30
2020/0157803 A1 * 5/2020 Weber ..... E04B 2/18
2024/0018776 A1 * 1/2024 Bell ..... E04B 2/46

* cited by examiner

INTERLOCKING CONSTRUCTION BLOCK SYSTEM

FIELD OF THE INVENTION

The invention generally relates to construction block systems, more particularly to interlocking construction blocks, structures formed with such blocks, and methods of constructing a structure with such blocks.

BACKGROUND OF THE INVENTION

Existing common building techniques require highly skilled tradespersons to mark-out and construct a structure, such as a wall or building. Some of these techniques are as follows. Typical brick or block systems are time intensive, costly to build, and viewed as environmentally objectionable because of the carbon footprint and low recyclability of the materials. Though having a lower environmental impact, timber systems are susceptible to mold that forms over time from moisture such that regular maintenance is required. Timber systems are also susceptible to fire. Poured concrete systems often require a faster build system with high costs and poor environmental characteristics. Plastic and composite systems often have poor structural characteristics and poor weatherability performance.

Various interlocking construction block systems are used for building various types of structures. However, there is an ongoing need for interlocking block systems that provide positive interlocking between blocks that can be secured together without the need for mortar and are environmentally friendly, and from which structures can be fabricated that exhibit high structural strength capable of withstanding high lateral and vertical loading without relying on excessive weight of blocks or mortar, and provide a reliable barrier against water ingress from the surrounding environment without requiring mortar to permanently bond and seal the blocks together.

BRIEF SUMMARY OF THE INVENTION

An interlocking construction block is provided that can be used as part of an interlocking construction block system for building various structures, such as walls and buildings.

According to one nonlimiting aspect, an interlocking construction block has a top side, a bottom side opposite the top side, a front side having a front face defining an exterior surface of the front side, a back side opposite the front side and having a back face defining an exterior surface of the back side, a right side having a right face defining an exterior surface of the right side, and a left side opposite the right side and having a left face defining an exterior surface of the left side. Each of the front side, the back side, the right side, and the left side of the interlocking construction block extends vertically between the top side and the bottom side, the exterior surface of each of the front face, the back face, the left face, and the right face has a horizontally undulating outer surface defining a horizontal profile comprising a series of repeating features with straight vertical sides. Each of the front side, the back side, the right side, and the left side of the interlocking construction block has an upper outer profile and a lower outer profile, each of the upper outer profiles and lower outer profiles has features that define a vertically undulating shape extending horizontally, and the vertically undulating shape of the upper outer profile is complementary to the vertically undulating shape of the lower outer profile.

According to another nonlimiting aspect, a structure includes first and second interlocking construction blocks as described above. One of the faces of the first interlocking construction block matingly abuts one of the faces of the second interlocking construction block to define a joint therebetween. The mating faces have an intermeshing fit formed by the series of repeating features thereof, and the intermeshing fit comprises a series of multi-point contacts between the first and second interlocking construction block that form a barrier to inhibit water from traveling horizontally along the joint from one side of the joint to an opposite side of the joint.

According to yet another nonlimiting aspect, a method of constructing the structure described above includes aligning the first interlocking construction block with the second interlocking construction block, abutting the face of the first interlocking construction block against the face of the second interlocking construction block at the joint, and sealingly interlocking the first interlocking construction block to the second interlocking construction block without using a fixative compound to couple the first and second interlocking construction blocks together.

In some embodiments, when two or more of the blocks are used in a system to build a structure, the system provides positive interlocking between blocks, allows blocks to be secured together without the need for mortar, and provides a good barrier against horizontal water seepage along the joints from one side of the blocks to the opposite side. The blocks are preferably capable of providing a relatively lightweight structural unit while still providing structural strength resistant to horizontal and vertical loads. In some embodiments, the blocks may be formed at least partly of recycled waste material(s) and/or may themselves be made of materials that can be easily recycled, thereby providing an environmentally friendly construction material that may have a reduced carbon footprint compared to other construction block systems.

These and other aspects, arrangements, features, and/or technical effects will become apparent upon detailed inspection of the figures and the following description.

DETAILED DESCRIPTION OF THE INVENTION

Figure 1:
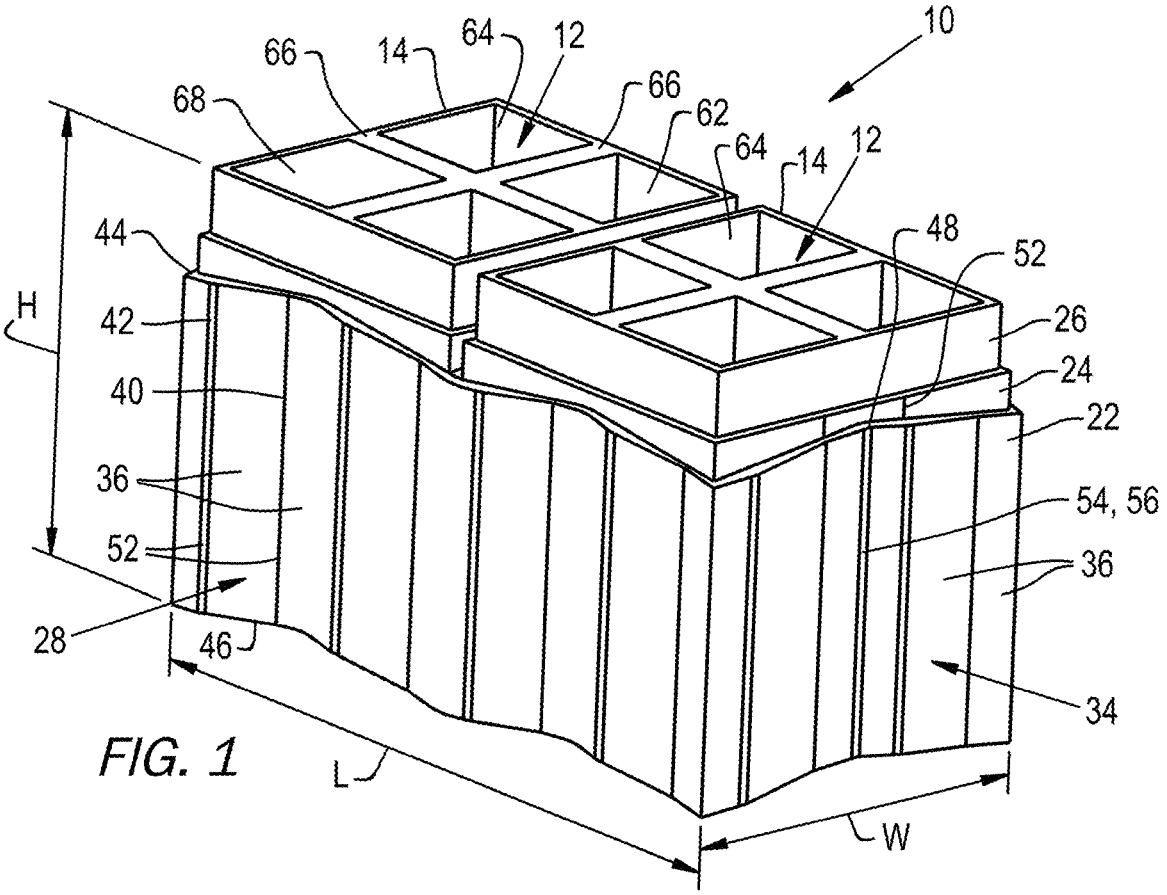
FIG. 1 is an isometric view of an interlocking construction block according to certain nonlimiting aspects of the invention, wherein a top, front, and right side of the block are visible.

The intended purpose of the following detailed description of the invention and the phraseology and terminology employed therein is to describe what is shown in the drawings, which relate to one or more nonlimiting embodiments of the invention, and to describe certain but not all aspects of what is depicted in the drawings, including the embodiment(s) depicted in the drawings and/or to which the drawings relate. The following detailed description also identifies certain but not all alternatives of the embodiment (s). As nonlimiting examples, the invention encompasses additional or alternative embodiments in which one or more features or aspects shown and/or described as part of a particular embodiment could be eliminated, and also encompasses additional or alternative embodiments that combine two or more features or aspects shown and/or described as part of different embodiments. Therefore, the appended claims, and not the detailed description, are intended to particularly point out subject matter regarded to be aspects of the invention, including certain but not necessarily all of the aspects and alternatives described in the detailed description.

To facilitate the description provided below of the embodiment(s) represented in the drawings, relative terms, including but not limited to, "proximal," "distal," "anterior," "posterior," "vertical," "horizontal," "lateral," "front," "rear," "side," "forward," "rearward," "top," "bottom," "upper," "lower," "above," "below," "right," "left," etc., may be used in reference to the orientation of the blocks and structures during its use and/or as represented in the drawings. All such relative terms are useful to describe the illustrated embodiment(s) but should not be otherwise interpreted as limiting the scope of the invention.

Turning now to the nonlimiting embodiments represented in the drawings, in FIGS. 1-8 an interlocking construction block 10 (hereinafter sometimes simply referred to as a "block") is schematically represented according to a first nonlimiting embodiment of the invention. The block has a generally rectangular cuboid or parallelepiped shape having undulating, multi-faceted, straight vertical exterior sides, designated herein as front, back, left and right sides of the block 10 that define, respectively, external front, back, left, and right faces 28, 30, 32, and 34 at the exterior of the block 10. According to preferred but nonlimiting aspects of the invention, the block 10 incorporates a multilayer interlocking system, latching system, and seal system that enable the block 10 to be intermeshed and secured to similarly configured blocks 10 (FIGS. 6 and 7), prevents or at least inhibits water ingress, and does not require any mortar to be used to secure the blocks together. The length (L) of each block 10 is preferably an iteration of its width (W), i.e., the length is an integer multiple of the width, plus or minus about 10%. When assembled with other blocks 10 of the same design, the block 10 is capable of providing in some arrangements a mortarless, water-resistant system for fixing the blocks 10 together to create a strong rigid structure, such as a wall.

Figure 3:
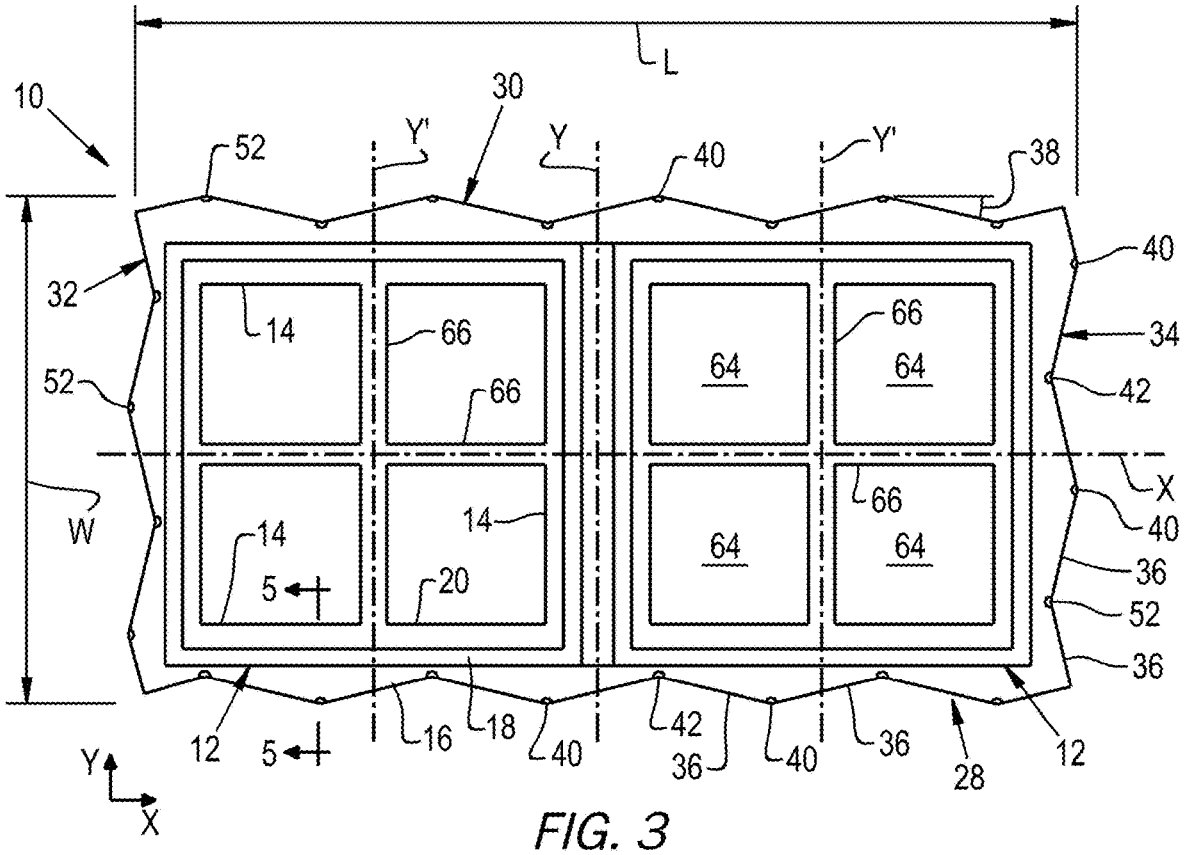
FIG. 3 is a top plan view of the interlocking construction block of FIG. 1.
Figure 4:
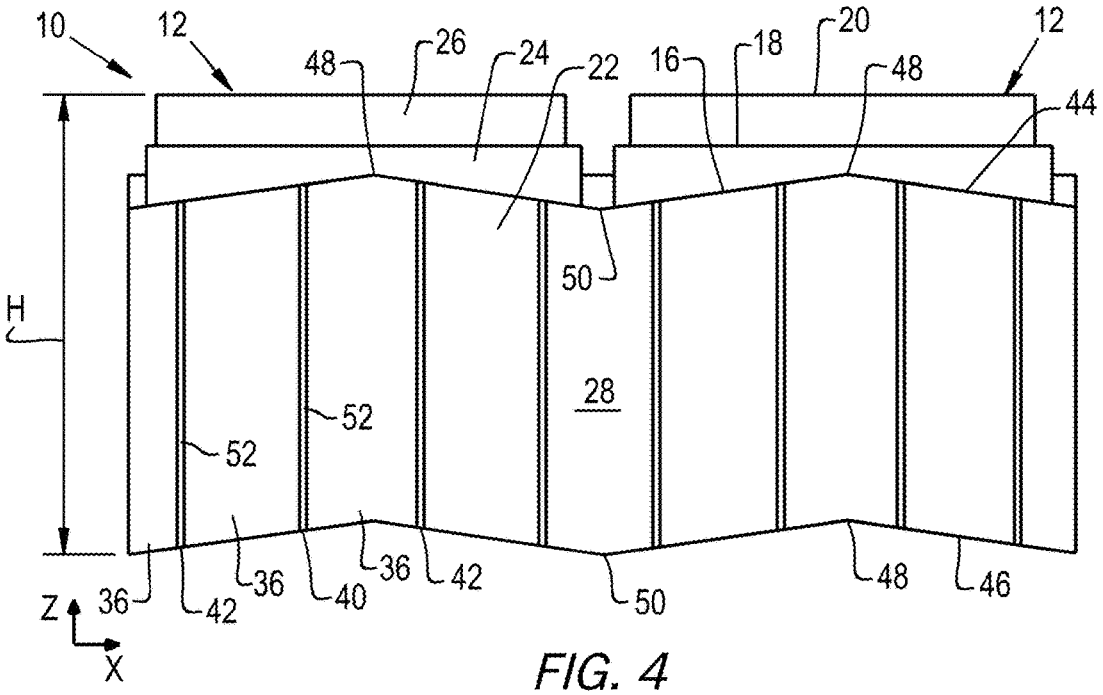
FIG. 4 is a front elevation view of the interlocking construction block of FIG. 1, wherein the front side is visible.

The length L of the block 10 ("block length") is in a direction along its longitudinal axis X between its left side and right side as represented in FIGS. 1 and 3. The width W of the block ("block width") is in a direction along its transverse axis Y between its front side and back side as represented in FIGS. 1 and 3. The height (H) of the block 10 ("block height") is in a direction along its vertical axis between its top and bottom sides as represented in FIGS. 1 and 4. Because the length L is an integer multiple (i.e., 1×, 2×, 3×, etc.) of the width W, the block 10 can be considered to have one or more generally square sections corresponding to the integer multiple that is repeated (if 2× or more) along the length. Each generally square section includes a generally square central core 12 surrounded by a generally vertical peripheral wall 14. Adjacent peripheral walls 14 of adjacent cores 12 in a single block 10 form a single monolithic structure.

Figure 5:
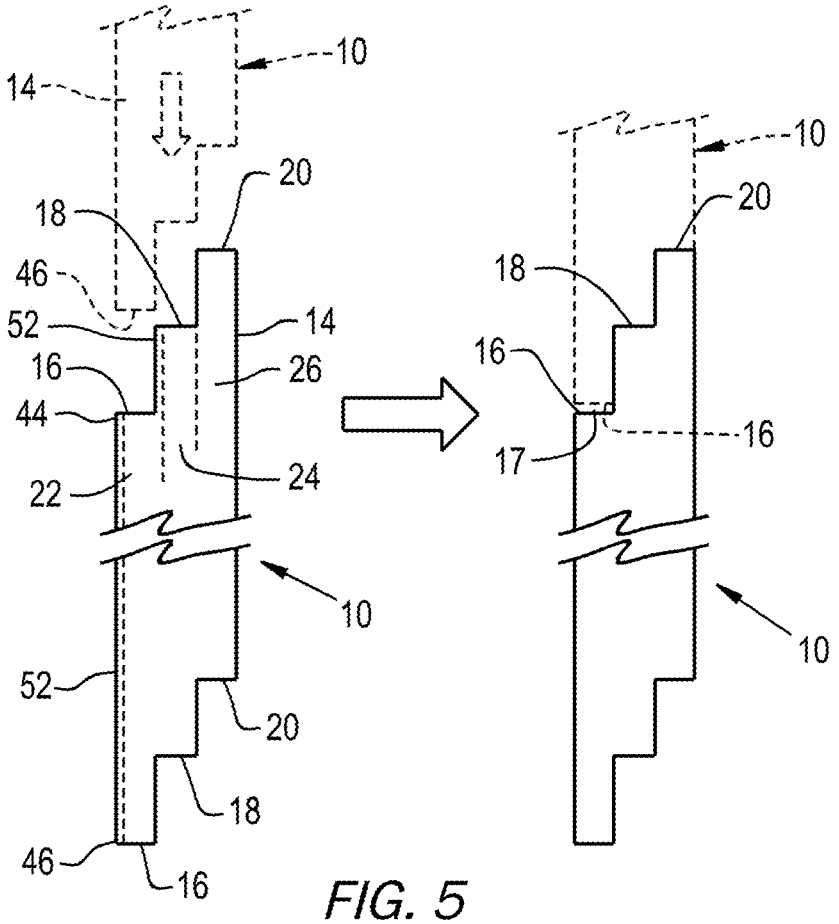
FIG. 5 is an enlarged fragmentary vertical cross-sectional view of a peripheral wall of the interlocking construction block along the line 5-5 in FIG. 3.

In FIG. 5, top and bottom cross-sectional profiles of a peripheral wall 14 ("wall profiles") are each represented as having a stepped configuration with three steps: an outer step 16, an intermediate (middle) step 18, and an inner step 20. The upper wall profile is identical and parallel with the lower wall profile, so that when two blocks 10 are stacked on one another their outer steps 16 face each other, their intermediate steps 18 face each other, and their inner steps 20 face each other, as is evident from FIG. 5. The intermediate and inner steps 18 and 20 of two stacked blocks 10 preferably abut each other, whereas the outer steps 16 of two stacked blocks 10 may not and, in preferred embodiments, do not abut so that a gap 17 is present that accommodates thermal expansion and forms a pathway for water droplets to drain away from the interior of a structure created with the blocks 10.

The three steps 16, 18, and 20 in the upper and lower wall profiles may be described as defining three layers across the thickness of the peripheral wall 14: an outer layer 22 extending the width of the outer step 16 of an individual block 10, an intermediate (middle) layer 24 extending the width of the intermediate step 18 of the block 10, and an inner layer 26 extending the width of the inner step 20 of the block 10. As depicted in FIG. 5, the outer layer 22 defines the front, back, left, and right faces 28, 30, 32, and 34 of the block 10, which can be generally described as defining four exterior peripheral surfaces of the block 10. The inner layer 26 defines interior surfaces of individual chambers 64 defined by webs 66, which together define cells 62 in each core 12. At each of the upper and lower wall profiles, the intermediate step 18 is above (i.e., nearer the top side) the outer step 16, and the inner step 20 is above the intermediate step 18. The outer step 16 defines the bottom side of the block 10, and the inner step 20 defines the top side of the block 10. As evident from FIGS. 1 through 5, the intermediate and inner layers 24 and 26 define the walls of the cores 12, which in the illustrated embodiment are shown to be square-shaped. The combined thicknesses of the intermediate and inner layers 24 and 26 are preferably sufficient to provide the walls of the cores 12 with rigidity and strength so that, when the block 10 is stacked on a second block 10 (the manner of which is schematically represented in FIG. 5), the inner and intermediate layers 24 and 26 are capable of preventing or at least inhibiting movement between the two stacked blocks 10. As such, the layers 24 and 26 and steps 18 and 20 can be described as defining a multilayer interlocking system of the blocks 10. Although the peripheral wall 14 is discussed in terms of layers for ease of reference, it is understood that the peripheral wall 14 may be and preferably is a monolithic structure with the layers being continuous with each other (e.g., not laminated, although such a laminated-type construction is possible). While the drawings depict a three-step configuration as represented in FIG. 5, a two-step configuration and configurations with more than three steps could be used.

Each of the front face 28, back face 30, left face 32, and right face 34 extends vertically between the top side and the bottom side of the block 10. As most clearly seen in FIG. 3, each of the faces 28, 30, 32, and 34 has a horizontally undulating outer surface defining a horizontal profile (i.e., in the X-Y plane; see FIG. 3). In the nonlimiting embodiment of FIGS. 1 through 8, the horizontally undulating outer surface contains a series of repeating symmetrical features with straight vertical sides that are complementarily configured to allow faces 28, 30, 32, and 34 of adjacent blocks 10 to mate together to define an undulating joint 60. In this example, each face 28, 30, 32, and 34 has a multi-faceted outer surface that is contoured in the horizontal direction to create the series of repeating symmetrical features as a plurality of facets 36, each being substantially straight and vertical so as to be generally orthogonal to the top side (surface) of the block 10. Referring to the front face 28, FIG. 1 depicts nine facets 36 defined at the outer surface of the front face 28 (i.e., defined by the outer layer 22), though it should be understood that the block 10 could have fewer or more facets 36 on its front face 28. The facets 36 are arranged such that each repeating symmetrical feature is symmetrical to form a symmetrical, angular, zig-zag or saw tooth profile that undulates in and out in the horizontal (X-Y) direction. Each facet 36 has a flat, planar exterior surface that is angled at an acute angle 38 relative to the longitudinal axis X of the block 10. Due to the symmetry of the undulating horizontal profile depicted in FIG. 3, each facet 36 is angled at the same acute angle 38 from the longitudinal axis X, though it is foreseeable than an asymmetrical profile could be employed. The direction of the angle 38 alternates from each successive adjacent facet 36, such that the facets 36 are alternatingly angled inwardly and outwardly along the longitudinal direction forming alternating apexes (peaks) 40 and troughs (valleys) 42. The acute angle 38 of each facet 36 is preferably between about 1° and about 20° and more preferably between about 5° and about 10° from the longitudinal axis X.

The facets 36 on the front face 28 are equal in number and parallel to corresponding facets 36 on the back face 30 so that the front face 28 of one block 10 is complementary to and is able to fit flush against the back face 30 of another block 10 with their opposing undulating facets 36 meshing with each other when their transverse axes Y are aligned. In this way, the opposing facets 36 intermesh and form a close intermeshing fit against each other that prevents or at least inhibits the blocks 10 from sliding horizontally relative to each other and keeps the blocks 10 aligned along their transverse axes Y. Similarly, the facets 36 on the left face 32 are equal in number and parallel to corresponding facets 36 on the right face 34 so that the left face 32 of one block 10 is complementary to and is able to fit flush with the facets 36 on the right face 34 of another block 10 when their longitudinal axes X are aligned with their opposing undulating facets 36 meshing with each other to form an intermeshing fit against each other that prevents or at least inhibits the blocks 10 from sliding horizontally relative to each other, as most clearly visible in FIG. 7. The facets 36 undulate in a repeating pattern, preferably with each facet 36 having approximately the same horizontal width. The repeating pattern spans the width W of each of the left face 32 and right face 34. Because the length L of the block 10 along the longitudinal axis X is an integer multiple (i.e., 1×, 2×, 3×, etc.) of the width W of the block 10 along the transverse axis Y, the repeating pattern repeats along the front face 28 and back face 30 the same integer multiple number of times. This allows each of the left face 32 and the right face 34 to also have a flush intermesh fit with each of the front face 28 and the back face 30 of another block 10 along and aligned with each of the multiples (iterations) of the width in the longitudinal direction. In FIGS. 1-4, the block length L is 2× the block width W.

In the nonlimiting embodiment shown in FIGS. 1 through 8, there are five facets 36 along each of the left face 32 and the right face 34, though it should be understood that the block 10 could have fewer or more facets 36 on these faces 32 and 34. The apexes 40 between each adjacent pair of facets 36 are laterally offset from the longitudinal axis X one half the width of a facet 36 so that pattern has three complete facets 36 and two half-width facets 36, one on each opposite end of the pattern. As there are nine individual facets 36 along each of the front and back faces 28 and 30 in the nonlimiting embodiment shown in FIGS. 1 through 8, the pattern of facets 36 at each of the front and back faces 28 and 30 is offset laterally from the transverse axis Y one half the width of a facet 36 such that central apexes 40 are offset one half width on opposite sides of the Y axis. The pattern of facets 36 at each of the front and back faces 28 and 30 has seven complete facets 36 and two half-width facets 36, one on each opposite end of the pattern. Each facet 36 is angled about 7° from its respective longitudinal or transverse axis. The facets 36 of the multi-faceted exterior surfaces may have other shapes with straight vertical walls, for example having a curved undulating profile or an angular undulating profile with a different pattern rather than the zig-zag angular undulating profile shown.

Figure 2:
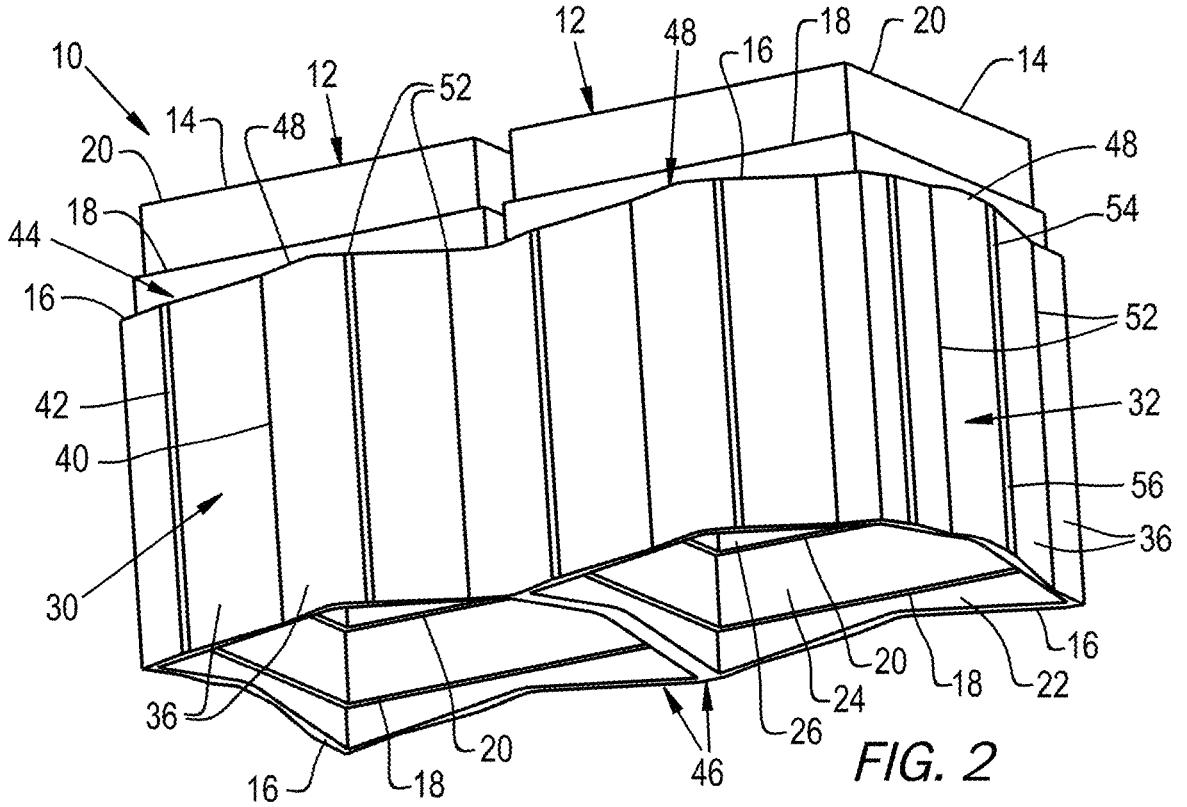
FIG. 2 is another isometric view of the interlocking construction block of FIG. 1, wherein a bottom, back, and left side of the block are visible.
Figure 6:
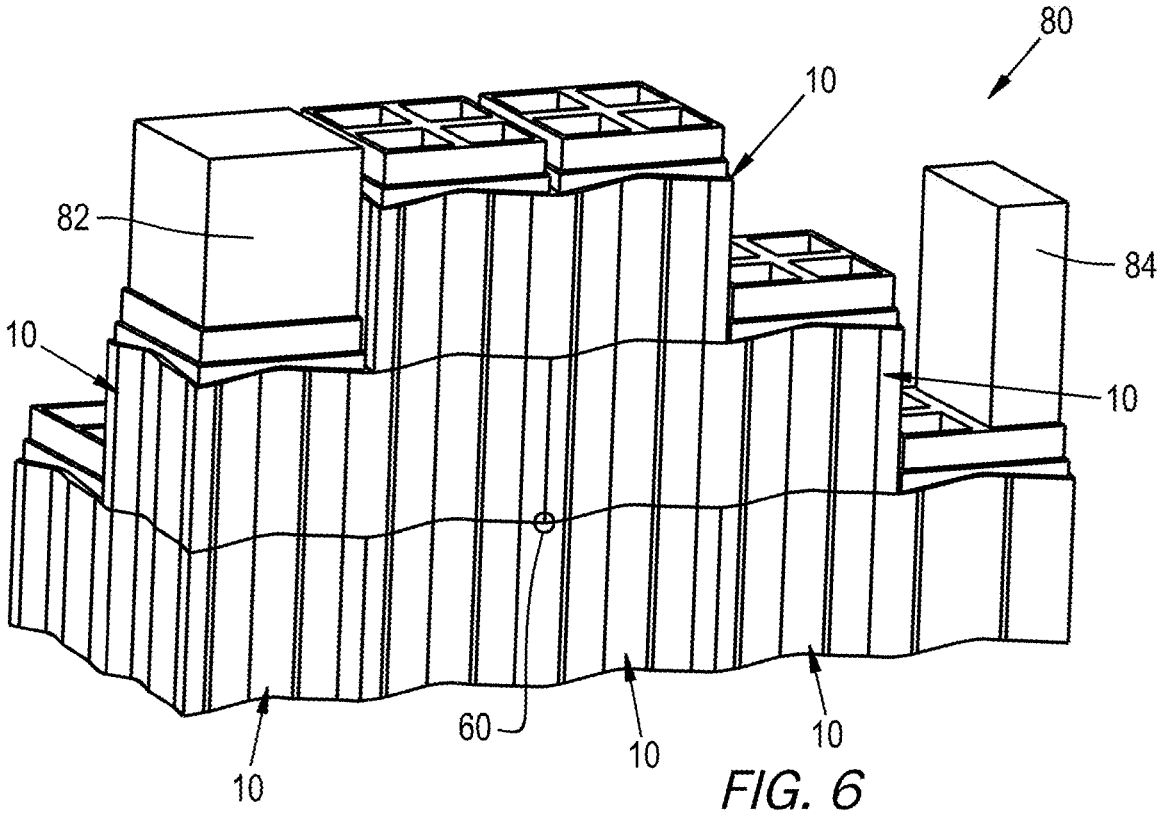
FIG. 6 is an isometric view of a structure constructed from components that include several of the interlocking construction block of FIG. 1, in accordance with a nonlimiting embodiment of the invention.

The outer layer 22 at the upper and lower wall profiles of the peripheral wall 14 of the block 10 also has features that define an undulating surface, in this case a vertically undulating shape (i.e, undulating in the Z direction of the X-Z plane; see FIG. 4) extending horizontally along each of the front, back, left, and right faces 28, 30, 32, and 34. As best seen in FIGS. 1, 2, 4, and the outer layer 22 is represented as defining an upper outer profile 44 along the top of the outer layer 22 and a lower outer profile 46 along the bottom of the outer layer 22. The features of the outer layer 22 that define the vertically undulating shapes are shaped and tapered such that the vertically undulating shape of each of the upper outer profile 44 and the lower outer profile 46 is a repeating vertically undulating shape, each shape being symmetrical about the respective longitudinal axis X or lateral axis Y. In the nonlimiting embodiment shown, the features located on each of the upper and lower outer profiles 44 and 46 define vertical apexes (peaks) 48 and vertical troughs (valleys) 50 that direct water to their lower edges and to the outer edges of the block 10. The shape of the lower outer profile 46 is complementary with the upper outer profile 44 of an adjoining block 10 on top of it, as shown in FIG. 6. Along each of the respective faces 28, 30, 32, and 34, the upper outer profile 44 is complementary to the lower outer profile 46. Focusing for example on the front face 28 visible in FIG. 4, each of the upper and lower outer profiles 44 and 46 has a symmetrical, angular, zig-zag or saw tooth profile comprising two shallow inverted V-shaped zig-zag angular saw tooth undulations in the Z direction, each defining two vertical apexes 48 aligned with the transverse centerlines of each width iteration and a single vertical trough 50 at the intersection of the adjacent inverted V-shaped saw teeth. The lower outer profile 46 of the front face 28 is parallel with (and thus has the same shape as) the upper outer profile 44 of the front face 28, and results in each facet 36 having a parallelogram shape such that the front face 28 comprises a series of parallelogram-shaped facets 36. Furthermore, each of the outer profiles 44 and 46 slopes downwardly from their apexes 48 relative to the horizontal (X-Y) plane. In the embodiment illustrated, the slopes of the outer profiles 44 and 46 may be disposed at an acute angle between about 1° and about 20° and more preferably between about 5° and about from the horizontal (X-Y) plane. In this particular embodiment, the outer profiles 44 and 46 are sloped at an angle of about 7° from the horizontal (X-Y) plane. The upper and lower outer profiles 44 and 46 along the front face 28 are identical and parallel to those on the back face 30.

Each of the upper and lower outer profiles 44 and 46 on the front and back faces 28 and 32 is an integer multiple of upper and lower outer profiles 44 and 46 on the left and right faces 32 and 34. In the illustrated embodiment in which the block length L is 2× the block width W, the upper and lower outer profiles 44 and 46 on each of the left and right faces 32 and 34 has a single centrally-located vertical apex 48 and slope downward relative to the horizontal (X-Y) plane and terminate at the adjoining front and back faces 28 and 30. The lower outer profile 46 is parallel with the upper outer profile 44, resulting in each facet 36 on the left and right faces 32 and 34 having a parallelogram shape such that the left and right faces 32 and 34 each comprises a series of parallelogram-shaped facets 36. The upper and lower outer profiles 44 and 46 on the left face 32 are identical and parallel to those on the right face 34.

With the configuration described above, when one block 10 is stacked on top of another block 10, the lower outer profiles 46 of the faces 28, 30, 32, and 34 of the upper block 10 intermesh flush with the upper outer profiles 44 of the faces 28, 30, 32, and 34 of the lower block 10. The intermeshing vertical undulations help to drain any accumulated water along a block joint away from the longitudinal and transverse centerlines of each block 10. The highest risk of water passing through a wall built of blocks 10 is at the joints 60 between blocks 10. The vertically undulating surfaces at the upper and lower wall profiles 44 and 46 of the peripheral wall 14 of each block 10 cause water at a joint 60 to run down the upper wall profiles 44 to the outer edges of the block 10, and thereby prevent or at least inhibit water from passing from the outside to the inside of the block and/or from the inside to the outside of the block 10.

In addition to the gaps 17 preferably present between the intermeshed outer steps 16 of two stacked blocks 10, water collection and/or drainage can be further promoted with recessed slots 52 formed in the exterior surface of the outer layer 22. Together, the gaps 17 and slots 52 inhibit horizontal infiltration of water and moisture along a joint 60 between two blocks 10 and/or shunt any collected water or moisture downwardly toward the sloped surfaces of the upper and/or lower outer profiles 44 and 46. Each slot 52 extends from the outer edge of the upper outer profile 44 to the outer edge of the lower outer profile 46 to collect any moisture and provide a channel along which the water can drain downwardly. In this example, a slot 52 is disposed vertically at each angled transition between adjacent facets 36 along each of the front, back, right, and left faces 28, 30, 32, and 34. Additional or fewer slots 52 may be provided, and the slots 52 may be located at different positions. In addition, the slots 52 may extend above the upper outer profile 44 on the exterior surfaces of the intermediate layer 24 and extend to the upper profile of the intermediate step. For example, as best seen in FIG. 1, the slots 52 on both sides of the central vertical apex 48 of the upper outer profile 44 extend up to the upper intermediate profile. These slots 52 allow moisture and water on the outer surface of the block 10 to form droplets that run down the block and then are guided onto the outer surface.

Figure 7:
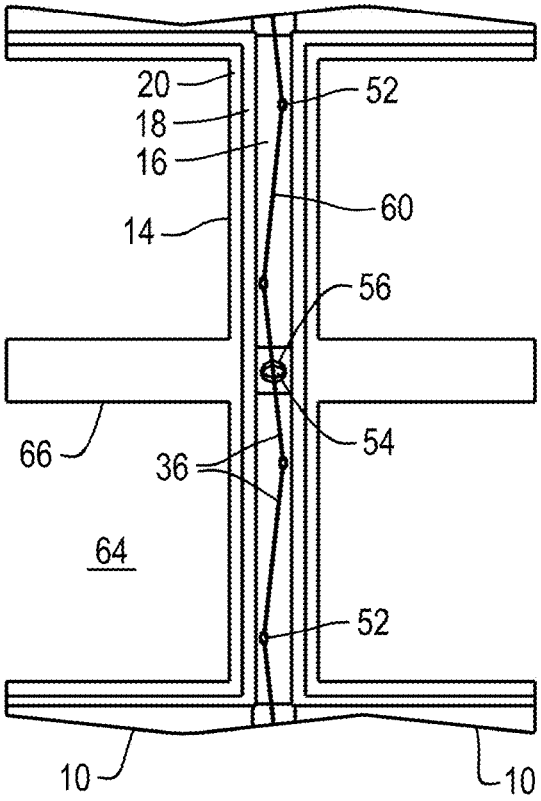
FIG. 7 is an enlarged fragmentary top plan view of a joint between two adjacent interlocking construction blocks of FIG. 6.

A seal member 54 is disposed and mounted in a vertical groove 56 (preferably somewhat larger than one of the slots) in the right face 34. The seal member 54 protrudes out of the groove 56 past the exterior surface of the right face 34 so as to be able to form a water resistant or watertight seal against a face 28, 30, 32, or 34 of a second block 10 abutting the right face 34. In the nonlimiting embodiment shown, the vertical groove 56 and the seal member 54 are aligned with the vertical apex 48 of the upper outer profile 44 on the longitudinal axis X. Another vertical groove 56 in the left face 32, also aligned with the vertical apex 48 of the upper outer profile 44 on the longitudinal axis X, is sized to receive the seal member 54 therein when the left and right faces 32 and 34 of two blocks 10 are fitted together to form a joint 60, as best seen in FIG. 7. The seal member 54 could alternatively be carried in the vertical groove 56 on the left face 32 and/or a seal member 54 could be mounted in both grooves 56. In some arrangements, for example at corner joints, it may be desirable to include a seal member 54 and groove 56 on either or both of the front and back faces 28 and 30, preferably vertically aligned with an apex 48 of the upper outer profile 44 aligned with the lateral axis Y' of any of the core 12.

As noted above, the multilayer interlocking system of the block 10 is formed by the inner layer 26 and the intermediate layer 24 of the peripheral wall 14 of each core 12, along with their corresponding inner and intermediate steps 20 and 18. Each of the inner layer 26, intermediate layer 24, inner step 20, and intermediate step 18 extends in a horizontal (X-Y) plane (i.e., orthogonal to the Z axis; see FIG. 4) around the periphery of the square core 12. The multilayer interlocking system has an upper portion defined by the upper inner and intermediate steps 20 and 18, and a lower portion defined by the lower inner and intermediate steps 20 and 18. As best seen in FIG. 5, when one block 10 is stacked on top of another block 10, the upper inner and intermediate steps 20 and 18 of the lower block 10 fit flush against the respective lower inner and intermediate steps 20 and 18 of the upper block 10. In this way, the upper inner and intermediate steps 20 and 18 define a male insert, and the lower inner and intermediate steps 20 and 18 define a female receptacle that receives the male insert and aligns and interlocks the upper and lower blocks 10 together.

Because of the square shape of the cores 12, an upper block 10 and a lower block 10 can be aligned and interlocked with their longitudinal axes X parallel to each other or with their longitudinal axes X orthogonal to each other. In the orthogonal case, the longitudinal axis X of each block 10 is aligned with the transverse axis Y' of one of the cores 12 of the other block 10. Although the cores 12 of the present example are square (in the X-Y plane; see FIG. 3), the cores 12 could have other shapes, such as circular, oval, triangular, octagonal, etc., that would also provide positive alignment and interlocking between upper and lower stacked blocks 10. As noted above, the stepped, square male and female design at the upper and/or lower outer profiles 44 and 46 of the peripheral walls 14 of each block 10 provides positive alignment and engagement of one block 10 to another, in particular, the intermediate and inner layers 24 and 26 and steps 18 and 20 at the peripheral walls 14 define a multilayer interlocking system that contributes to the strength of a structure (e.g., a wall) constructed with the blocks 10 and carries a proportion of the load bearing capability of a structure constructed from the blocks 10. Due to their load-bearing and alignment function, the intermediate and inner layers 24 and 26 and steps 18 and 20 are sized and shaped relative to each other to ensure that the desired fit and position is set and maintained throughout the structure.

The cellular interior configuration of the block 10 shown in FIGS. 1 through 8 can be utilized to reduce weight, reduce the amount of material used in each block 10 and provide allowances for thermal expansion and contraction. As previously noted, the cellular interior configuration of the block 10 includes the cores 12 and their cells 62, the latter of which comprise the individual hollow chambers 64 defined and divided by the webs 66 within each core 12. In the depicted example, the cores 12 each have four cells 62 defined therein, though fewer or more cells 62 are foreseeable. The chamber 64 of each cell 62 extends vertically through the block 10 between an open bottom end at the bottom side of the block 10 and an open top end at the top side of the block 10. The webs 66 are orthogonal to each other. Each web 66 extends horizontally across the core 12 from peripheral wall 14 to peripheral wall 14. Each web 66 is aligned with a respective one of the longitudinal axis X or the core's transverse axis Y', thereby forming an orthogonal cross that divides the core 12 into four separate vertically oriented cells 62. In other embodiments, the core 12 may be divided into two cells 62, for example by a single web 66 disposed along either one of the longitudinal axis X or the core's transverse axis Y'. Each web 66 is preferably a relatively thin, vertically oriented wall with its top surface either flush with or spaced below the top surface of the block 10 and its bottom surface either flush with or spaced above the plane of the lower inner profile so as to not interfere with vertical stacking and interlocking of the blocks 10 on top of each other. In yet other embodiments, the cores 12 may not be divided at all, and may simply define a single cell 62. In some arrangements, the core 12 is slightly less than approximately 4 in.×4 in. (2.5 cm×2.5 cm), which enables a standard 4×4 inch structural member (e.g., lumber, steel post, etc.) to be received in or pass through the core 12 (if not subdivided by any webs 66) with a small tolerance gap between the structural member and the inner surface of the peripheral wall 14. The chambers 64 and webs 66 help ensure that the block 10 is lightweight. The size and shape of the chambers 64 can be selected and/or tailored and/or optimized to suit a particular construction application. For example, different cores 12 in a particular block 10 may have different configurations of chambers 64 and/or different blocks 10 may have different combinations of configurations of chambers 64. The webs 66 provide rigidity for reducing side deflection as a result of the loads and pressures/forces. The cellular configuration of the block 10 can be selected (e.g., adjusted and/or set) prior to manufacturing to fit the framing or reinforcing system design that is to be used for a particular structure. This may be dependent, for example, on what resources and/or materials are available for construction of a given structure, such as wood, concrete, steel, composite, or organic matter. The cellular block design creates a lightweight structure with good strength properties in both the vertical and lateral directions.

Optionally, insulation 68 may be disposed in one or more of the chambers 64. For example, expanding insulation 68 can be injected into a chamber 64 during the wall construction or the insulation 68 may be provided as an integral part of the block 10 during its manufacture. Insulation 68 incorporated in the cellular chambers 64 may provide a series of thermal barriers to insulate through the cross section of the block 10, which may improve energy efficiency of a structure built with the blocks 10.

Figure 8:
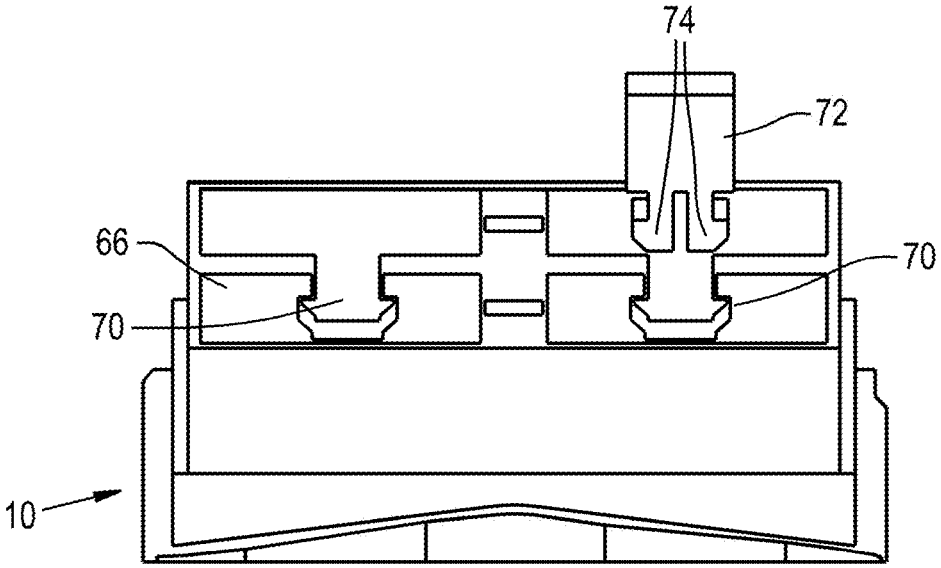
FIG. 8 is an enlarged fragmentary cross-sectional detail of an interlocking construction block according to certain nonlimiting aspects of the invention.

As best seen in FIG. 8, the blocks 10 may incorporate a latching system to connect and lock a lower block 10 to an upper block 10 when stacked on top of each other. The latching system includes a shaped latching receptacle (recess) 70 and a complementary shaped latching pin 72 that locks into the latch receptacle 70 to lock two stacked blocks 10 together. The receptacle 70 and pin 72 may be located in mating sections of the upper and lower blocks 10, for example, on any one or more of the webs 66 within one or more cores 12 of the block 10. The latch pin 72 is complementary to and fits within the latch receptacle 70. In this example, the latch pin 72 has a non-return catch and lever system that has two resilient arms 74 extending in parallel and spaced laterally apart from each other, and each arm 74 has a projection that extends laterally outwardly from each arm 74. The distal end of each arm 74 also includes a chamfer to help resiliently push the arms 74 resilient together and guide the projections into complementary features in the latch receptacle 70, where the resilient arms 74 of the latch pin 72 expand to interlock the pin 72 with the receptacle 70. The latching system will click when locked, thereby providing positive feedback to an installer when the block 10 is correctly set in place and fitted together during installation.

The latch pin 72 in this embodiment is a separate component from the block 10 itself. For example, the latch pin 72 may be a molded insert. However, if higher volumes and lower product costs are desired, then the latch pin 72 can be formed as an integral part of the block 10. In such an arrangement, the male and female parts of the latching system are split between the upper and lower sections of the block 10 and aligned such that the male section of one block 10 links up with the female section of a second block 10 when the blocks 10 are stacked and joined together.

FIG. 6 shows one possible example vertical wall structure 80 built with a number of the blocks 10 and an integrated internal skeleton frame configured to promote structural integrity. In this example, the internal skeleton frame comprises vertical framing members 82 and 84 received within and vertically through two or more partly aligned vertically stacked blocks 10 to provide additional lateral and vertical structural support to the wall. The cell size of the vertically aligned central cores 12 is selected/designed for the framing system that is to be used. Typically, the framing member is a timber or metal stud, although reinforced concrete or composite are other possible non-limiting alternatives. Clearances between the framing member and the interior surface(s) of the cells allow for expansion and contraction of the framing member. As seen in the left side of FIG. 6, a square frame member 82, such as a common 4×4, that fills the entire hollow chamber can be used if the hollow chamber has only a single cell 62 and no webs 66. As seen on the right side of FIG. 6, a rectangular frame member 84, such as a common 2×4, that only fills half of the hollow chamber 64 can be used if the hollow chamber is divided into two cells 62 by a single web 66. Further variations are also possible. The blocks 10 ensure that the frame is pitched for optimum structural strength. The internal skeleton frame, whether continuous or sectional, can be designed to carry the weight of a roof, joists, and/or any other structures. In addition, other features, such as doors and windows, can be secured to the internal skeleton frame. The internal skeleton frame is incorporated within the structure and is designed to brace all walls together and is used to fix cross members as well as the roof. The standard sizes of the block system and defined position of the cells for the uprights ensures that the inner frame and roof system is correctly positioned and pitched for optimal strength. The internal frame in some designs is the main load bearing feature.

In some embodiments, half thickness blocks 10 may be provided and used within the structure, for example to allow for cross framing to secure and support door and window frames. The internal skeleton frame can be secured to the foundations and/or a base block 10 with a flat, thicker lower section. The base block 10 may have predrilled vertical holes that are used to set and fix the first layer of blocks 10 on top of a foundation or other support structure. This can help ensure, for example, that the first full course of blocks 10 above the base blocks 10 is flat and level.

FIG. 7 shows a joint 60 formed along the point of contact interface of opposing left and right faces 32 and 34 of two blocks 10 abutting each other. The right face 34 of the block 10 on the left is abutting and interlocked with the left face 32 of the block 10 on the right. The opposing slots 52 on the opposing interconnecting surfaces along the joint 60 form relieved areas that define drain channels, which allow moisture and water along the joint to form droplets and drain downwardly. The opposing grooves 56 on the two opposing block faces 32 and 34 form a vertical seal channel. The seal member 54 is partially received in the groove 56 in one block 10, and the groove 56 in the adjacent block 10 is the mating face that receives the remainder of the seal member 54. The seal member 54 may be affixed in one of the grooves 56, for example with an adhesive or with a friction fit, and engages against the opposite groove to form a water-resistant seal between the opposing block faces 32 and 34. Preferably, the seal 54 extends continuously along the entire vertical extent of the opposing faces 32 and 34 from the upper outer step profile 16 to the lower outer step profile 16. As evident from FIG. 7, at the joint 60 there are multiple contact points, and the slots 52 and any gaps between the faces 32 and 34 enable moisture that has infiltrated the joint to form water droplets that can then flow downward through the slots 52 and out of the block for example, along the gaps 17 between facing outer steps 16 of stacked blocks 10. The contact points and tight clearances between the mating faces 32 and 34 at the joint 60 also inhibit or prevent water from penetrating into the block.

When the blocks 10 butt up against one another, the fit between their opposing faces 28, 32, and 34 can create air pockets within the joints 60 that can improve the insulative properties of a structure constructed from the blocks 10. The shapes of the upper and/or lower outer profiles 44 and 46 allow for block expansion and contraction caused by thermal changes that the blocks 10 are subjected too and allow fixed points to be maintained. The symmetrical shape of the block 10 with vertical sides allows a block 10 to be rotated in 90° orientations and lock/seal together when the upper and lower inner sections are aligned.

Figure 9:
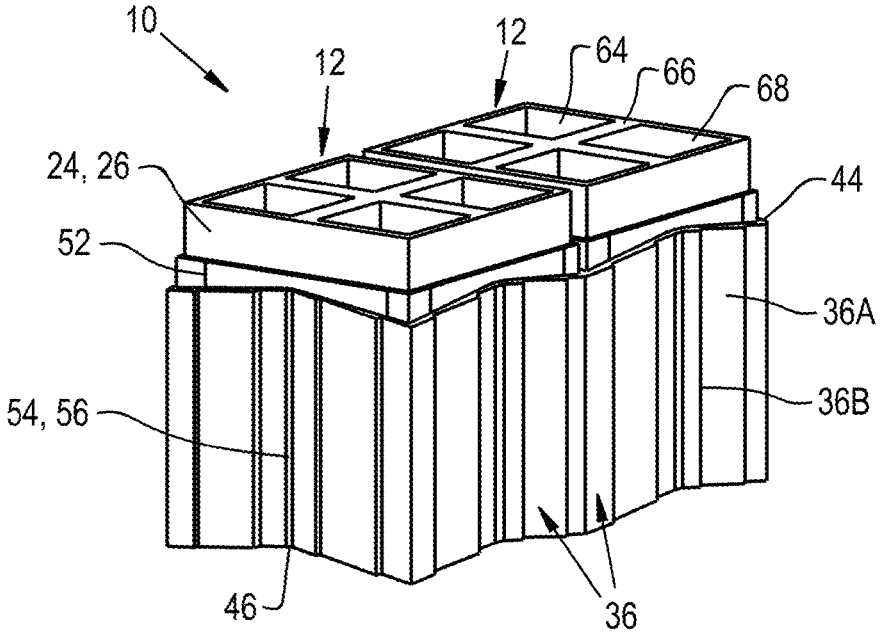
FIG. 9 is an isometric view of a second embodiment of an interlocking construction block according to certain nonlimiting aspects of the invention, wherein a top, front, and left side of the block are visible.
Figure 11:
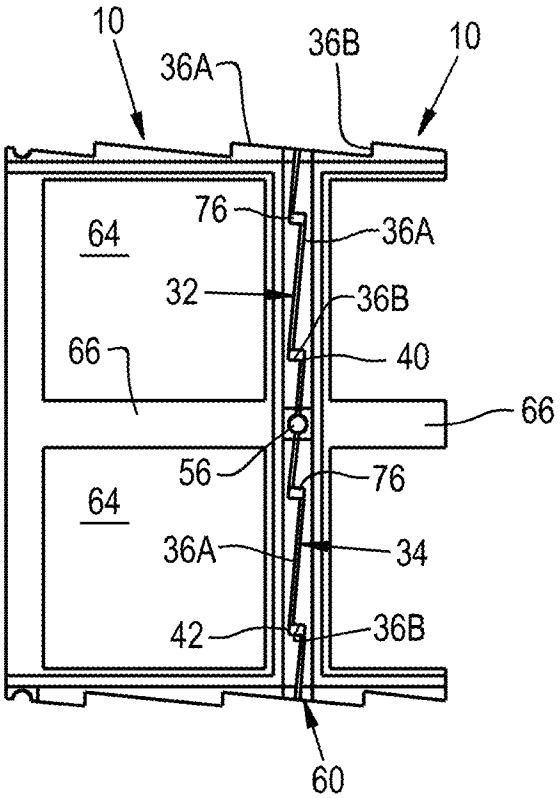
FIG. 11 is an enlarged fragmentary top plan view of a joint between two adjacent interlocking construction blocks of FIG. 11.
Figure 10:
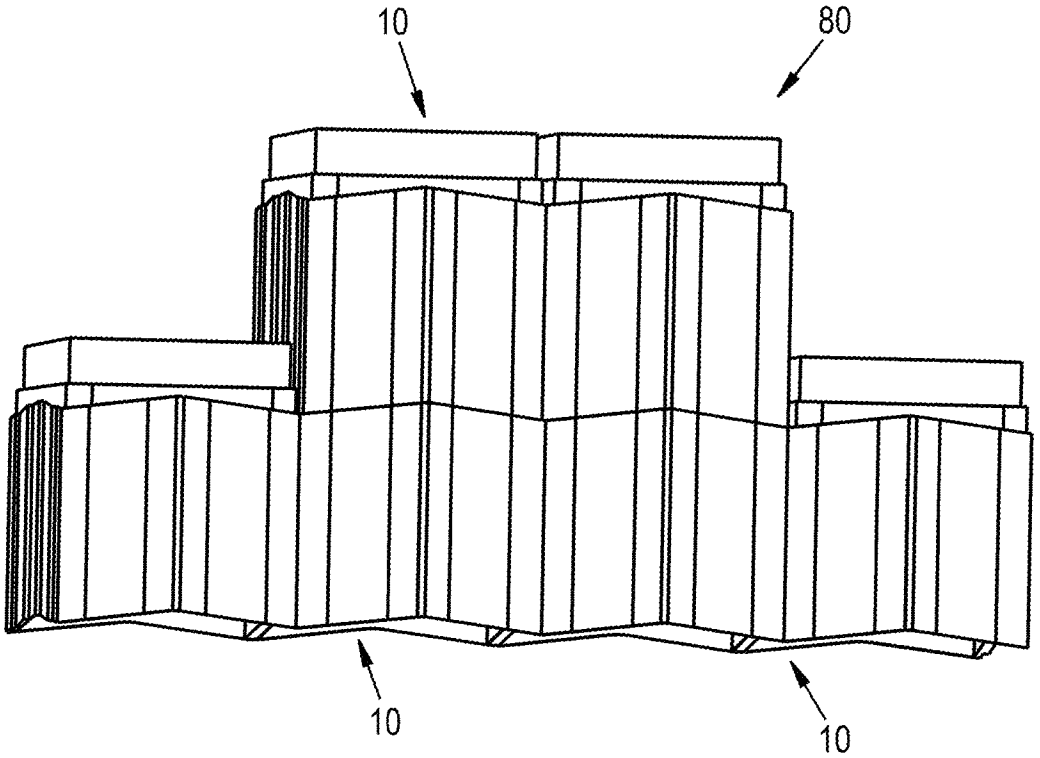
FIG. 10 is an isometric view of a structure constructed from three of the interlocking construction block of FIG. 9, in accordance with a nonlimiting embodiment of the invention.

FIGS. 9 through 11 represent an alternative embodiment of the interlocking construction block 10 shown in FIGS. 1 through 8. In view of similarities between the embodiments represented in the drawings, the following discussion of FIGS. 9 through 11 will focus primarily on aspects of the embodiment of FIGS. 9 through 11 that differ from the embodiment of FIGS. 1 through 8 in some notable or significant manner. Other aspects of the embodiment of FIGS. 9 through 11 not discussed in any detail can be, in terms of structure, function, materials, etc., essentially as was described for the embodiment of FIGS. 1 through 8.

Similar to the blocks 10 of FIGS. 1 through 8, in FIGS. 9 through 11 the blocks 10 comprise facets 36 that are contoured to form an angular, zig-zag or saw tooth profile that undulates in and out in the horizontal direction while having a straight vertical exterior surface that is generally orthogonal to the top surface of the block 10. In contrast to the facets 36 of FIGS. 1 through 8, the facets 36 do not define a series of repeating symmetrical features. Instead, FIG. 11 depicts the facets 36 as comprising a first set of alternating facets 36A that are similarly angled at an acute angle from the longitudinal axis X, and a second set of alternating facets 36B that are similarly angled at an angle from the longitudinal axis X that is different than the facets 36A. As evident from FIG. 11, the acute angle of each facet 36A may be between about 1° and about 20°, for example, about 1° and about 10° from the longitudinal axis X, whereas the facets 36B may be approximately normal to the longitudinal axis X. The facets 36A and 36B are alternatingly angled inward outwardly, forming alternating apexes (peaks) 40 and troughs (valleys) 42. As evident from FIG. 11, which depicts two blocks 10 abutting at their respective left and right faces 32 and 34, this saw tooth configuration facilitates the creation of clearances or gaps 76 between the adjacent facets 36B of the intermeshed blocks 10, through which water droplets can escape the joint 60 formed by the opposing faces 32 and 34 of the blocks 10.

In reference to all of the embodiments represented in the drawings, the joints 60 between blocks 10 may be mortarless (including not requiring mortar, adhesive, putty, or other similar semi-fluid fixative compound). However, if desired, adhesive may be used along the joints 60, for example if more extreme environmental conditions will be encountered. The tortuous paths formed by the fit between the faces 28, 30, 32, and 34 of the blocks 10 at each joint 60 inhibit or prevent water ingress through a structure formed with the blocks 10. Abutting opposing surfaces, clearances, grooves, and tapered surfaces collect and direct the water to the outer surfaces of the blocks 10, inhibiting the water from crossing from a wet outer side of a block 10 to a drier inner side of the block 10. The configurations of the blocks 10 also prevent or at least inhibit water from collecting inside the blocks 10 and to prevent or at least inhibit possible failure due to freezing. In addition, the multilayer interlocking system provided by the intermediate and inner layers 24 and 26 of the peripheral walls 14 surrounding the cores 12 ensure that the strength of the structure is maintained throughout the structure as the wall thickness is maintained at each connection point or block 10 to block joints between levels of blocks 10. The multilayer interlocking system also ensures that each block 10 is accurately aligned due to clearances being optimized in the block design. There is always a multi-point contact (i.e., two or more points of contact) on opposing mating faces 28, 30, 32, and 34 of adjacent blocks 10 to inhibit moisture from traveling horizontally through the joints 60.

The blocks 10 can be provided in many different dimensional variations. It is expected that the most common dimensions used for the blocks 10 will be a double width unit, that is, its length L is twice its width W, to allow a robust brick pattern and a double wall construction. In this dimensional configuration, blocks 10 can be inserted at 90° to each other and allow two blocks 10 to exactly span the length of a third block 10. The symmetrical shape of the block 10 also allows a double wall with an offset block pattern. Other possible sizes include a single square block 10, and blocks 10 with lengths 1 that are 2×, 3×, or more, of the width W. However, the length is preferably pitched based directly on an integer multiple of its width of 2, 3, 4 or any addition integer number. This can allow for more rapid construction. It also allows the blocks 10 to be used as cross members for spanning doors and window openings or other spans.

The block 10 is preferably manufactured by molding a monolithic block structure. The block 10 can be made of almost any moldable material, such as plastic, clay, cement, epoxy, and so on. In order to reduce environmental impact of the block 10, it is desirable to use about 50% or more of waste material, i.e., recycled material, within the block 10. Because mixed waste is a significant environmental burden, incorporating a significant amount of mixed waste within the manufacturing process and then in the product would be desirable. The mixed waste may itself be moldable material, such as some recycled plastics or rubber, and/or the mixed waste may include some non-moldable materials that are captured within a matrix of moldable material. It is believed that the physical size of any individual component that is not fused within the structure of the block 10 is preferably less than or equal to about 1.0 $mm^3$, as this ensures that the size does not affect the structural integrity of the block 10. However, other sizes may be desirable in some applications. It may be desirable to use virgin moldable matrix material in combination with various recycled waste materials or in some circumstances to use up to 100% recycled materials, as long as the materials can be sufficient molded into the form of the blocks 10 and provide suitable structural strength for a given application.

To summarize more generally, interlocking construction block systems disclosed herein provide molded blocks 10 that can be used as part of a system designed to withstand the internal and external forces that the structure is subjected to. The blocks 10 are designed to interlock and seal to each other. The lightweight cellular construction and outer shapes of the blocks 10 prevent or at least inhibits water ingress, such that the blocks 10 are suitable for indoor and outdoor use. The design of the block 10 allows unskilled persons to erect the structure. The raw material, cross webs and horizontal surfaces, along with the outer block structures and internal framing provide the load bearing capabilities of the block 10.

The cellular design of the blocks 10 provides a lightweight product, and when the blocks are interlocked together, the blocks 10 provide a closed cell structure with good insulative properties. The cellular design of the blocks 10, coupled with the angled faces 28, 30, 32, and 34 of the blocks 10, allows the blocks 10 to expand and deflect if temperature causes excess expansion, thereby cushioning the joints 60 between blocks 10 and limiting lateral movement to a structure and its fixed points. This can help reduce or eliminate failures caused by thermal expansion.

The multilayer interlocking system and cellular design increase strength and rigidity in both the vertical and horizontal directions. The faces 28, 30, 32, and 34 provide multi-point contact, inhibiting water/moisture ingress and are shaped to divert water to the outside of the blocks 10. The multilayer interlocking system inhibits block separation due to physical or thermal forces. Incorporating the flexible seal member 54 within the faces 28, 30, 32, and 34 further improves the water-resistant integrity of a structure built with the blocks and also allows for thermal changes in expansion.

As described above, in some embodiments an internal skeleton frame can be incorporated into a structure constructed of the blocks 10 to help brace the structure together. The chambers 62 within the cores 12 allow such an internal skeleton frame to be disposed at set pitch distances within the structure to provide for optimal framing and load bearing capability. The internal skeleton frame can be incorporated within the system design, for example, to brace walls of a building together, and/or used to fix cross members, a foundation, roof joists, and floor joists of a building. The blocks 10 can be accurately manufactured in standard sizes to ensure that the inner frame and roof system of a building is correctly positioned for optimal strength.

As previously noted, block lengths L are iterations of block width (depth) W, preferably at tolerances of about ±10%. That is, the length of the block 10 is an integer multiple of the width of the block 10, for example having a length to width ratio of 1:1 (i.e., square), 2:1, 3:1, 4:1, or higher. One preferred design targets a typical 4-inch (10 cm) width such that the blocks 10 are nominally 4 in.×4 in. (10 cm×10 cm), 4 in.×8 in. (10 cm×20 cm), and so on. The height of the block 10 is not necessarily limited to any particular proportion or height. However, in one preferred arrangement, the nominal height of the block 10 is approximately equal to the nominal width of the block 10 so that the left face 32 and the right face 34 are generally square. In one arrangement, the height of the block 10 is nominally 97 mm (4 in.), excluding the multilayer interlocking systems of the cores 12. However, other dimensions for the height can also be used. An internal skeleton frame as described above can be incorporated within the cellular structure of the blocks 10 at pre-defined intervals (e.g., ≤16½"pitch) to optimize structural strength and load bearing capabilities.

The latching system depicted in FIG. 8 provides positive feedback to an installer when the latch 74 locks together and the blocks 10 are correctly installed and locked together. Alternatively, there are a number of options in which the blocks 10 can be used without latching. If the latching system is not used, a structure can be deconstructed and a new unit can be built.

A custom cell design can be used to allow for an internal timber, concrete, composite, or steel skeleton frame to be incorporated within the blocks 10. These can then act as anchor points for other elements of a building, such as the roof, which tie the horizontal structures to a base or foundation.

The fit created by the angular faces 28, 30, 32, and 34, as well as seal members 54 and/or slots 52 that run from the top side to the bottom side of each block 10, provides multi point contact at each joining face 28, 30, 32, and 34, seals gaps, restricts water and/or air ingress, and improves thermal, environmental and structural rigidity of a structure (wall) built from the blocks 10. The flexible seal members 54 also allow small amounts of movement and/or expansion and contraction of the block 10.

In some embodiments, the blocks 10 can be more environmentally friendly than existing construction blocks. The blocks 10 may be a sustainable product made in part using recycled polymers, such as waste plastics, that can be used to create a dense product that is easily reused or recycled. To manufacture such a block 10, mixed waste in a bulk and random form and size, along with additives and polymers, are broken down and processed so that the size of any component encapsulated (not fused) within the structure of the block 10 will have a volume ≤1.0 $mm^3$. Such blocks 10 can also have excellent recyclability. The blocks 10 can either be dismantled and reused in a new construction, or if they have reached the end-of-life cycle, they can be recycled and molded into a new construction block 10.

As previously noted above, though the foregoing detailed description describes certain nonlimiting aspects of one or more particular embodiments of the invention, alternatives could be adopted by one skilled in the art. For example, the blocks 10 and their components could differ in appearance and construction from the embodiments described herein and shown in the drawings, functions of certain components of the blocks 10 could be performed by components of different construction but capable of a similar (though not necessarily equivalent) function, and various materials could be used in the fabrication of the blocks 10 and/or their components, as well as skeleton frame members used with the blocks 10. As such, and again as was previously noted, it should be understood that the invention is not necessarily limited to any particular embodiment described herein or illustrated in the drawings.

The invention claimed is:

1. An interlocking construction block comprising:

a top side;

a bottom side opposite the top side;

a front side having a front face defining an exterior surface of the front side;

a back side opposite the front side, the back side having a back face defining an exterior surface of the back side;

a right side having a right face defining an exterior surface of the right side;

a left side opposite the right side, the left side having a left face defining an exterior surface of the left side; and a longitudinal axis that extends through the left and the right sides;

wherein each of the front side, the back side, the right side, and the left side of the interlocking construction block extends vertically between the top side and the bottom side, the exterior surface of each of the front face, the back face, the left face, and the right face has a horizontally undulating outer surface defining a horizontal profile comprising a series of repeating features with straight vertical sides;

wherein each of the front side, the back side, the right side, and the left side of the interlocking construction block has an upper outer profile and a lower outer profile, each of the upper outer profiles and lower outer profiles has features that define a vertically undulating shape extending horizontally, and the vertically undulating shape of the upper outer profile is complementary to the vertically undulating shape of the lower outer profile; and wherein the vertically undulating shape of each of the upper outer profiles and the lower outer profiles comprises vertical apexes and vertical troughs, the upper outer profiles comprise a single centrally-located first apex of the vertical apexes located at the longitudinal axis at the left side and a single centrally-located second apex of the vertical apexes located at the longitudinal axis at the right side, and the upper outer profiles at the left side and the right side slope downwardly from the first and second apexes until terminating at the front side and the back side to direct water to the front face and the back face.

2. The interlocking construction block of claim 1, wherein the repeating features of the horizontally undulating outer surfaces of each of the front face, the back face, the left face, and the right face are each symmetrical.

3. The interlocking construction block of claim 2, wherein the horizontal profile of each of the front face, the back face, the left face, and the right face are each an angular saw tooth profile.

4. The interlocking construction block of claim 1, wherein the repeating features of the horizontally undulating outer surfaces of each of the front face, the back face, the left face, and the right face are each nonsymmetrical.

5. The interlocking construction block of claim 4, wherein the horizontal profile of each of the front face, the back face, the left face, and the right face are each an angular saw tooth profile.

6. The interlocking construction block of claim 1, wherein the horizontally undulating outer surface of each of the front face, the back face, the left face, and the right face is formed by a plurality of facets that form an angular saw tooth profile comprising apexes and troughs.

7. The interlocking construction block of claim 6, wherein each of the plurality of facets has a flat, planar exterior surface and a parallelogram shape.

8. The interlocking construction block of claim 7, wherein the plurality of facets comprise a first set of alternating facets each disposed at an acute angle relative to the longitudinal axis of the interlocking construction block.

9. The interlocking construction block of claim 8, wherein the plurality of facets comprise a second set of alternating facets each disposed at the acute angle relative to the longitudinal axis of the interlocking construction block, wherein a direction of the acute angle alternates from each successive adjacent facet of the plurality of facets such that the plurality of facets are alternatingly angled inwardly and outwardly along the longitudinal direction to alternatingly form the apexes and the troughs.

10. The interlocking construction block of claim 8, wherein the plurality of facets comprise a second set of alternating facets each disposed at an angle that is normal to the longitudinal axis of the interlocking construction block such that the plurality of facets are alternatingly angled inwardly and outwardly along the longitudinal direction to alternatingly form the apexes and the troughs.

11. The interlocking construction block of claim 1, wherein the vertically undulating shape of each of the upper outer profiles and the lower outer profiles forms an angular saw tooth profile.

12. The interlocking construction block of claim 1, wherein the horizontal profile of the front face is identical and parallel to the horizontal profile of the back face.

13. The interlocking construction block of claim 1, wherein the horizontal profile of the left face is identical and parallel to the horizontal profile of the right face.

14. The interlocking construction block of claim 1, wherein the horizontal profiles of the front and back faces are each an integer multiple of the horizontal profiles of the left and right faces.

15. The interlocking construction block of claim 1, wherein the front side, the back side, the left side, and the right side are defined by a peripheral wall surrounding a central core, wherein the peripheral wall has an upper wall profile and a lower wall profile, wherein each of the upper wall profile and the lower wall profile has a stepped configuration, and the upper wall profile is complementary to the lower wall profile.

16. The interlocking construction block of claim 15, wherein each of the upper wall profile and the lower wall profile includes an inner step on an interior of the peripheral wall, and an outer step on an exterior of the peripheral wall, and an intermediate step between the inner step and the outer step.

17. The interlocking construction block of claim 15, wherein the central core comprises a hollow chamber surrounded by the peripheral wall, and the hollow chamber extends vertically from an open bottom end at the bottom side of the interlocking construction block to an open top end at the top side of the interlocking construction block.

18. The interlocking construction block of claim 17, wherein the central core comprises a web extending generally horizontally thereacross to form a plurality of hollow chambers within the central core.

19. The interlocking construction block of claim 15, wherein the peripheral wall includes an outer layer extending from an outer step in the upper wall profile that defines the upper outer profile to an outer step in the lower wall profile that defines the lower outer profile, wherein an exterior surface of the outer layer defines the front face, the back face, the left face, and the right face.

20. The interlocking construction block of claim 1, further comprising a latching system comprising a latch receptacle and a latch pin that latches into the latch receptacle.

21. The interlocking construction block of claim 20, wherein the interlocking construction block is a first interlocking construction block that is stacked on a second interlocking construction block, and the latch pin of the first interlocking construction block is latched with the latch receptacle of the second interlocking construction block.

22. The interlocking construction block of claim 1, further comprising:

a first groove in the right face, wherein the first groove is vertically oriented; and a seal member mounted in the first groove, wherein the seal member protrudes out of the first groove relative to the exterior surface of the right face.

23. The interlocking construction block of claim 22, further comprising a second groove in the left face, wherein the second groove is configured to sealingly receive a seal member therein.

24. The interlocking construction block of claim 23, wherein each of the first groove and the second groove is vertically aligned with the longitudinal axis of the interlocking construction block.

25. The interlocking construction block of claim 1, the interlocking construction block comprising a plurality of slots disposed on at least one face of each of the front face, the back face, the left face, and the right face, wherein each slot of the plurality of slots extends from an upper edge of the at least one face to a lower edge of the at least one face to collect moisture migrating horizontally along the one face and provide a channel along which the water drains downwardly.

26. The interlocking construction block of claim 25, wherein the slots are aligned with vertices of the horizontal profile.

27. The interlocking construction block of claim 1, wherein the interlocking construction block has a length from the left side to the right side and a width from the front side to the back side, and the length is an integer multiple of the width.

28. The interlocking construction block of claim 1, wherein the interlocking construction block is formed of molded material comprising about 50% or more of recycled waste material.

29. A structure comprising:

a first interlocking construction block according to claim 1; and a second interlocking construction block according to claim 1, wherein one of the front face, the back face, the left face, and the right face of the first interlocking construction block is a first mating face that matingly abuts a second mating face defined by one of the front face, the back face, the left face, and the right face of the second interlocking construction block to define a joint therebetween, and wherein the first and second mating faces of the first and second interlocking construction blocks have an intermeshing fit formed by the series of repeating features thereof, and the intermeshing fit comprises a series of multi-point contacts between the first and second interlocking construction blocks that form a barrier to inhibit water from traveling horizontally along the joint from one side of the joint to an opposite side of the joint.

30. A method of constructing the structure of claim 29, the method comprising:

aligning the first interlocking construction block with the second interlocking construction block;

abutting the first mating face of the first interlocking construction block against the second mating face of the second interlocking construction block to form the joint therebetween; and sealingly interlocking the first interlocking construction block with the second interlocking construction block without using a fixative compound to couple the first and second interlocking construction blocks together.

* * * * *